US009892906B2

(12) United States Patent
Kowalski et al.

(10) Patent No.: US 9,892,906 B2
(45) Date of Patent: Feb. 13, 2018

(54) LAMP AND HEADLIGHTING ARRANGEMENT FOR OBTAINING A COLOR APPEARANCE IN AN AUTOMOTIVE HEADLIGHT

(71) Applicant: KONINKLIJKE PHILIPS N.V., Eindhoven (NL)

(72) Inventors: Jacek Maciej Kowalski, San Jose, CA (US); Wiktor Plawski, San Jose, CA (US); Tomasz Michal Mamenas, San Jose, CA (US); Piotr Jerzy Kozar, San Jose, CA (US); Mateusz Wojciech Marek, San Jose, CA (US); Lukas Kuepper, San Jose, CA (US); Hans-Alo Dohmen, San Jose, CA (US); Anna Justyna Zydorczyk, San Jose, CA (US)

(73) Assignee: Koninklijke Philips N.V., Eindhoven (NL)

( * ) Notice: Subject to any disclaimer, the term of this patent is extended or adjusted under 35 U.S.C. 154(b) by 96 days.

(21) Appl. No.: 14/901,660

(22) PCT Filed: Jun. 26, 2014

(86) PCT No.: PCT/EP2014/063536
§ 371 (c)(1),
(2) Date: Dec. 28, 2015

(87) PCT Pub. No.: WO2014/207112
PCT Pub. Date: Dec. 31, 2014

(65) Prior Publication Data

US 2016/0148798 A1 May 26, 2016

(30) Foreign Application Priority Data

Jun. 27, 2013 (EP) ..... 13173915

(51) Int. Cl.
*H01K 1/26* (2006.01)
*H01K 1/32* (2006.01)
(Continued)

(52) U.S. Cl.
CPC ..... *H01K 1/26* (2013.01); *F21S 48/1172* (2013.01); *F21S 48/13* (2013.01); *H01K 1/32* (2013.01); *H01K 9/08* (2013.01)

(58) Field of Classification Search
CPC .... H01K 1/26; H01K 1/32; H01K 9/08; F21S 48/1172; F21S 48/13
(Continued)

(56) References Cited

U.S. PATENT DOCUMENTS 5,578,893 A 11/1996 Yamamoto
5,690,409 A * 11/1997 Boebel ..... F21S 48/145 362/255
(Continued)

FOREIGN PATENT DOCUMENTS

CN 1723532 A 1/2006
CN 101019204 A 8/2007
(Continued)

OTHER PUBLICATIONS

EPO Application No. 13173915.3, filed Jun. 27, 2013, "Extended EP Search Report", dated Nov. 6, 2013, 7 pages.
(Continued)

*Primary Examiner* — Laura Tso

(57) ABSTRACT

A lamp 10 is described which may be used in an automotive headlight 12. The lamp 10 comprises at least one filament 20 within a transparent lamp vessel 16. A color filter portion 30 is provided through which light is emitted with a color change. The lamp vessel 16 further comprises a color transparent portion, through which light is emitted without a color change. The color transparent portion is arranged
(Continued)

such that an illumination beam of light 40 is emitted through the color transparent portion to achieve a non-colored illumination. The color filter portion 30 is arranged such that only peripheral and/or scattered portions of light are emitted through the color filter portion to achieve a color appearance of the headlight 12 in operation of the lamp 10.

21 Claims, 4 Drawing Sheets

(51) Int. Cl.
*H01K 9/08* (2006.01)
*F21S 8/10* (2006.01)

(58) Field of Classification Search
USPC ..... 362/516, 510
See application file for complete search history.

(56) References Cited

U.S. PATENT DOCUMENTS 6,281,630 B1 * 8/2001 English ..... H01K 9/08 313/112
6,583,564 B1 * 6/2003 Kiryu ..... F21S 48/1186 313/634
6,798,138 B2 * 9/2004 Gervelmeyer ..... H01J 61/40 313/110
2008/0116780 A1 5/2008 Kupper et al.
2008/0266891 A1 10/2008 Kupper et al.

FOREIGN PATENT DOCUMENTS

CN 101517313 A 8/2009
CN 102099893 A 6/2011
CN 103098169 A 5/2013
DE 102006060022 A1 6/2008
DE 102010002084 A1 8/2011

OTHER PUBLICATIONS

EPO as ISA for PCT/EP2014/063536, filed Jun. 26, 2014, "International Search Report and Written Opinion", dated Sep. 11, 2014, 9 pages.
First Office Action dated Aug. 26, 2016, China Application No. 201480036620.9, 17 pages.
Second Office Action dated May 9, 2017, China Patent Application No. 201430036620,9, LUM Reference No. 2013P01007WOCN, 16 pages.
Third Office Action dated Sep. 11, 2017, China Patent Application No. 201480036620.9, 5 pages.

* cited by examiner

LAMP AND HEADLIGHTING ARRANGEMENT FOR OBTAINING A COLOR APPEARANCE IN AN AUTOMOTIVE HEADLIGHT

CROSS-REFERENCE TO RELATED APPLICATIONS

The present application is a § 371 application of International Application No. PCT/EP2014/063536 filed on Jun. 26, 2014 and titled "Lamp and Headlighting Arrangement for Obtaining a Color Appearance in an Automotive Headlight," which claims the benefit of EP Application No. 13173915.3, filed Jun. 27, 2013. Both PCT/EP2014/063536 and EP 13173915.3 are incorporated herein.

FIELD OF THE INVENTION

The invention relates to a lamp for use in an automotive headlight and to a headlighting arrangement for a motor vehicle.

BACKGROUND OF THE INVENTION

Different types of lamps are known for use in an automotive headlight. The present invention relates to incandescent lamps, i. e. lamps where light is generated from one or more filaments arranged within a transparent lamp vessel.

Known lamp types comprise lamps where a shield is arranged adjacent to a filament such that light emitted from the filament is partly blocked, and such that an angular shielded region is obtained into which no direct light from the filament is emitted. The obtained illumination beam of light includes a bright/dark cutoff caused by the shield, which may be used to form in a reflector an illumination beam pattern with a bright/dark cutoff, which may be used e. g. for low beam illumination. An example of a double filament lamp where a shield is provided adjacent to one of the filaments is a H4 lamp. Other lamps, in particular single filament lamps such as e. g. a H7 lamp do not provide a shield.

Automotive regulations cover geometrical parameters of an automotive lamp, such as the position and size of filaments as well as functional parameters, such as the color of the light emitted. Such regulations provide that the illumination beam of light emitted from the lamp to serve the purpose of illuminating the road in front of the motor vehicle is required to have a white color, i. e. the color of the emitted light must be within a specified white field of color coordinates.

DE 10 2010 002 084 A1 describes a halogen incandescent lamp for a vehicle front reflector comprising, in one embodiment, a lamp vessel with two filaments, of which one serving for low beam lighting is arranged adjacent to a shield. The lamp vessel comprises an optical filter to obtain violet coloring of the light emitted. In different embodiments, a color filter may be applied to a single filament lamp without a shield, and the lamp vessel may be fully or partially covered by the color filter. The light emitted from the lamp is within the white field of the ECE regulations, but has a violet coloring, such that the vehicle may be recognized by the light color. In a specific embodiment, it is disclosed that part of the lamp vessel is not covered by a color filter, resulting in an uncolored central part of the light beam and a colored edge region of the light beam. Part of the light beam is therefore colored. The coloring of this part of the beam should also remain with the boundaries set by the regulations and therefore only a limited color change is possible.

SUMMARY OF THE INVENTION

It may be considered an object of the invention to provide an improved lamp suited for automotive headlights, in particular a lamp which provides a substantial white illumination beam, which beam is still perceived to have a pleasant light color.

This object is achieved by a lamp according to claim 1 and by a headlighting arrangement according to claim 12. Dependent claims refer to preferred embodiments of the invention.

The present inventors have considered that for an optical color appearance of a lamp installed in an automotive headlight, it may not be necessary to obtain a differently colored illumination beam of light (i. e. the main portion of the luminous flux emitted from the lamp, that is emitted into the main illumination directions and is used in a headlighting reflector to form the illumination beam on the road in front of the motor vehicle). Instead, for changing the appearance, i. e. how the light emitted from a head light is perceived, it may be sufficient to change the color of only a peripheral portion of the light, i. e. light emitted from the lamp into directions peripheral to (or even outside of) the main illumination directions. This may lead to a lamp and a headlighting arrangement, which can obtain a strongly colored appearance, while the actual illumination beam is still white, i. e. within the white field defined in the corresponding regulations.

According to the invention, a lamp is proposed with at least one filament within a transparent lamp vessel. Preferably, the lamp is a halogen lamp.

The lamp vessel comprises a partial color filter, i. e. is provided with a color filter portion. This color filter portion has optical properties such that light passing through it is emitted with a color change. The color filter portion may be provided as a color filter coating on the lamp vessel.

Since, the lamp only comprises a partial color filter, the lamp vessel further comprises a color transparent portion, through which light is emitted without a color change. It should be noted that the present invention is mainly concerned with illumination and appearance, such that the above applies to the visible spectrum of light, such that e. g. a portion of the lamp vessel is still regarded as color transparent if it only comprises an ultraviolet or infrared filter.

The color transparent portion and the color filter portion are arranged on positions of the lamp vessel specially chosen with regard to the position of the filament and the directions of the light emitted therefrom. Since the illumination beam of light, i. e. the main part of the luminous flux as explained above, should remain at least essentially within the white field defined by regulations, it is emitted, at least mainly, through the color transparent portion of the lamp vessel. Thus, a non-colored illumination is achieved, i. e. an illumination beam that is of white color within the boundaries set by corresponding regulations, in particular ECE regulations relating to halogen lamps.

The color filter portion is arranged such that a peripheral and/or scattered portion of light is emitted through it. As will become apparent in connection with preferred embodiments, a peripheral portion of light may be emitted under directions at the periphery of the illumination beam. Further, scattered portions of light may be emitted from the lamp into all directions, not only into the direction of the illumination beam.

The skilled person thus recognizes that these scattered and/or peripheral portions of light, which pass through the filter portion of the lamp vessel, will not substantially contribute to the illumination beam of light. Instead, they will be emitted from the lamp into different directions as scattered light and/or into peripheral regions of the illumination beam.

Surprisingly, the inventors have found that these scattered and/or peripheral portions of the light that undergo a color change at the color filter portion are sufficient to obtain a color appearance of the lamp operated within a reflector. That is, since the illumination beam of light is reflected from a reflector in a directed way into defined directions close to the optical axis, the headlamp, if viewed under larger angles with the optical axis (i. e. the center of the main illumination direction), may be perceived as emitting a colored beam of light due to the colored peripheral/scattered light portions.

Thus, the invention allows to obtain a lamp with non-colored (white in the sense of e. g. ECE regulations) illumination, that is nonetheless perceived as giving a color appearance to the headlamp when in operation.

In a preferred embodiment, the lamp comprises an opaque, i.e. non-transparent top cover, which may e.g. be provided as a coating on the top of the lamp, i.e. on the axial end opposite to the electrical connections. According to a preferred embodiment, the top cover has a colored surface. This may be the inner surface, or the outer surface, or both. In a preferred embodiment, it is sufficient to provide a color coating at the outer surface of the top cover. The color of the surface corresponds to the color of the light emitted from the filament through the color filter portion. For example, if the filtered light is perceived green, then the opaque top cover may advantageously be provided in green color, too. This enhances the color appearance and does not substantially influence the illumination beam of light. However, any scattered light portions reflected e.g. within the lamp (in case of an inner colored surface), or at the exterior of the lamp (in case of an outer colored surface) will be perceived as having the same color as the color filtered light. Thus, the coloring effect is enhanced. Additionally, a colored outer surface may be perceived in the headlight even when the lamp is turned off.

According to one embodiment, a shield may be arranged adjacent to the filament, such that light emitted from the filament is partially blocked. As will become apparent in the discussion of further preferred embodiments, the filament adjacent to the associated shield may be used for low beam lighting, and there may be a further filament, in particular for high beam illumination, arranged within the lamp vessel. It is then preferred that at least a part of the color filter portion is arranged within the angular shielded region, i. e. in the angular region behind the shield. Such an angular region may be defined of radial directions from the center of the filament located within a central plane perpendicular to a longitudinal axis of the lamp.

Light incident in this shielded region will not be direct light from central portions of the filament, but will be composed of light portions scattered at the lamp vessel or at holding wires arranged within the lamp vessel for fixing the filaments and/or the shield. Additionally to these scattered light portions, a part of the color filter portion may also receive, as will be visible from preferred embodiments, direct light from the filament. However, this will preferably correspond to peripheral light portions, i. e. outside of the angular range of the illumination beam of light. Generally, it is preferred that the largest part of the color filter portion is arranged within the shielded region.

According to a further preferred embodiment of the invention, the color filter portion is formed as a partial cylinder surface over an angular region that is as least as wide as the angular shielded region. Further preferred, the angular region of the color filter portion may be slightly broader than the angular shielded region, i. e. such that the color filter portion is arranged over the full angular shielded region and overlaps to a certain, limited degree with the edges of the non-shielded region. In this case, additional to the scattered light portions passing through the color filter portion within the shielded region, there will be peripheral portions of the light emitted from the filament which are directly emitted through the color filter portion. However, these peripheral portions will appear in the headlamp under peripheral angles of the resulting illumination beam. For example, the color filter portion may have an angular width which is 120-160% of the width of the angular shielded region, i. e. such that there may be e. g. 1-30% overlap on one or both sides.

Preferably, the color filter portion may be arranged non-symmetrically relative to the shield. In particular, there may be an overlap between the color filter portion and the non-shielded region of different size at both opposing side edges of the shield.

In longitudinal extension and position, the color filter portion is arranged preferably adjacent to the filament and/or the shield. For example, the color filter portion may have a longitudinal extension, measured along a longitudinal axis of the lamp, which is 50-300%, further preferred 150-250% of the longitudinal extension of the shield. In an upright position of the lamp, with the electrical connections arranged below, it is preferred that a lower edge of the color filter portion is arranged at substantially the same longitudinal location as the lower end of the filament, the term "substantially" in this respect being understood to enclose deviations of about +/−10% of the filament length.

The illumination beam of light may be defined according to the angles under which light forming this illumination beam is emitted, e.g. relative to a measurement plane oriented perpendicular to the longitudinal axis and arranged at the center of one filament.

In vertical directions, the illumination beam may be defined to be emitted in directions forming angles of at least +/−30° from this measurement plane.

In radial directions, the illumination beam of light may be defined, for a lamp without a shield, to cover the full 360° range of directions within the measurement plane. For lamps including a shield, the illumination beam of light may be defined as light emitted in radial directions over an angular range of e. g. 120°. The light emitted in these directions in the measurement plane will fully pass through the color transparent portion. The color filter portion may then only be arranged outside of the 120° angular range of the illumination beam, such that only peripheral portions emitted outside of the 120° angular range pass through it.

Preferably, the color filter portion may be obtained by a corresponding coating provided on the lamp vessel, preferably on the outside of the lamp vessel.

The color filter coating may be e. g. a sol-gel coating, in particular a sol-gel nanocoating, or, alternatively, a luster coating. The color effect achieved may be e.g. green, yellow, pink/purple, orange or blue.

The level of absorption may be chosen in accordance with the desired color effect. Generally it is preferred to provide the color filter coating to achieve absorption levels of 5% or above, for most colors of 30% or above. In preferred embodiments, a level of absorption which has proven advantageous varies for the different color effects. While for yellow color a preferred absorption level may be relatively low with only e.g. 4-20%, in particular 5-11%, preferred absorption levels for other colors such as green, pink/purple, orange and blue will be e.g. 30-70%, in particular 40-60%.

In one embodiment, the color filter portion is provided as a cylinder shape around one part of the lamp vessel, and the color transparent portion is provided also as a cylinder shape around the lamp vessel, surrounding the filament. Preferably, the color filter portion is provided around a lower portion of the lamp, i.e. looking at an upright oriented lamp with the electrical connections oriented below, the color filter portion may extend in axial direction from a pinch portion (where the lamp vessel is sealed, and electrical wires may extend through the seal).

While it is generally possible to provide a color filter portion which is non-continuous, i.e. provides separate spaced-apart parts of the lamp vessel with the color filter property, it is preferred to provide the color filter portion continuous, i.e. as only one surface bordering on the color transparent portion. In a particulary preferred embodiment, the color filter portion is provided only at the lower portion of the lamp vessel, the color transparent portion is provided directly adjacent to the color filter portion in an upper portion surrounding the filament, and an opaque top cover is provided directly adjacent to the color transparent portion on the top of the lamp.

BRIEF DESCRIPTION OF THE DRAWINGS

The above and other objects, features and advantages of the present invention will become apparent from the following description of preferred embodiments, in which:

FIGS. 1 and 2 show a first embodiment of a halogen lamp 10 suited for use in a reflector 14 of a motor vehicle headlight 12 as schematically shown in FIG. 3.

DETAILED DESCRIPTION OF EMBODIMENTS

Figure 1:
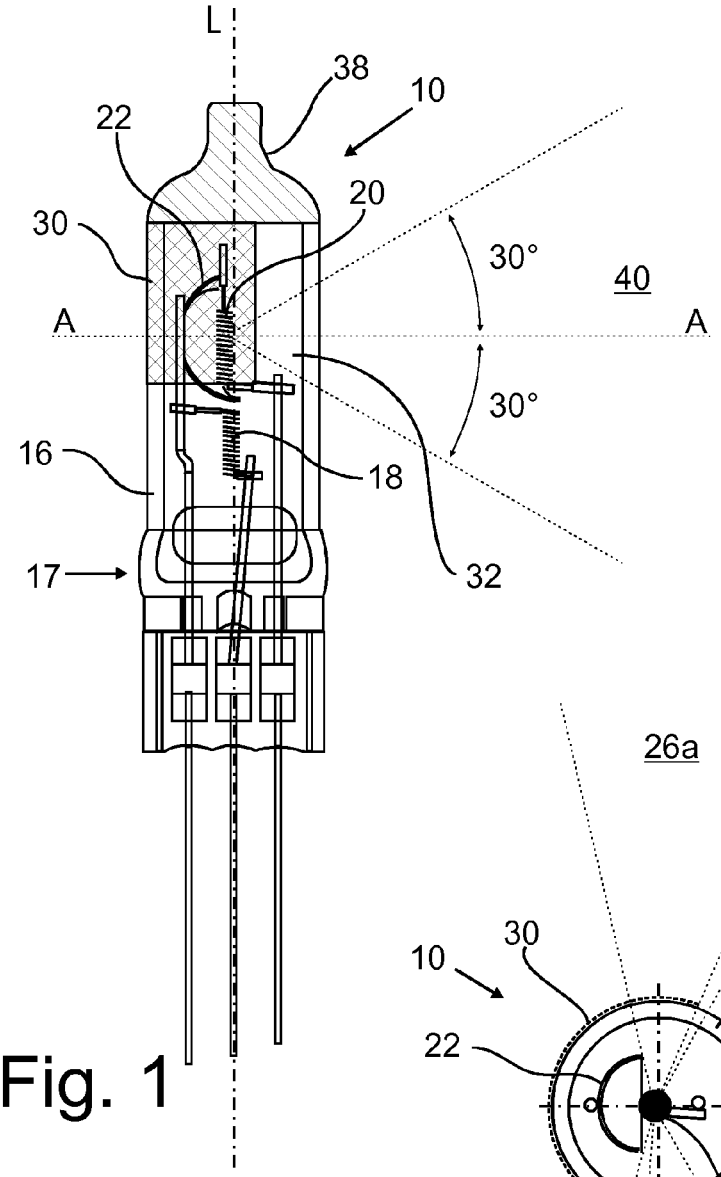
FIG. 1 shows a side view of a first embodiment of a lamp.
Figure 2:
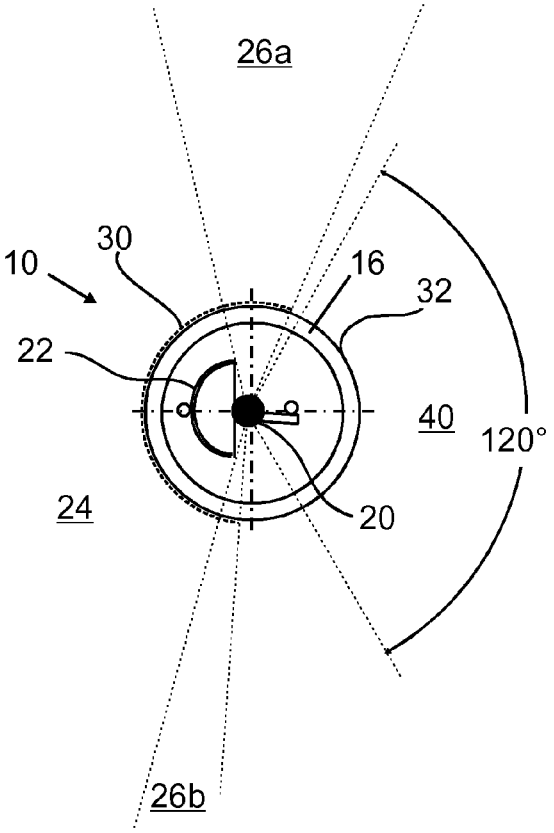
FIG. 2 shows a sectional view of the lamp of FIG. 1 with the section along line A . . . A.

The lamp 10 shown in the example of FIG. 1, FIG. 2 is a double filament halogen lamp. A glass vessel 16 which is transparent but has an opaque top 38 encloses a low-beam filament 20 and a high-beam filament 18, electrically connected and mechanically mounted to mounting wires. The lamp vessel 16 is sealed at a pinch portion 17, and the mounting wires extend through the pinch seal. An optical shield 22 is also arranged within the vessel 16 at one of the mounting wires and is positioned adjacent to the low-beam filament 20, i. e. covering the low-beam filament 20 over its full longitudinal extension in the direction of the longitudinal axis L. The shield 22 is provided as a curved metal sheet. It serves to block a portion of light which is emitted from filament 20 in operation into the direction of the shield 22.

As shown in the sectional view of FIG. 2, a shielded region 24 is formed in a measurement plane A, oriented perpendicularly to the longitudinal axis L and positioned at the center of the low-beam filament 20. This shielded region in the example shown covers an angular range of about 150°.

Figure 3:
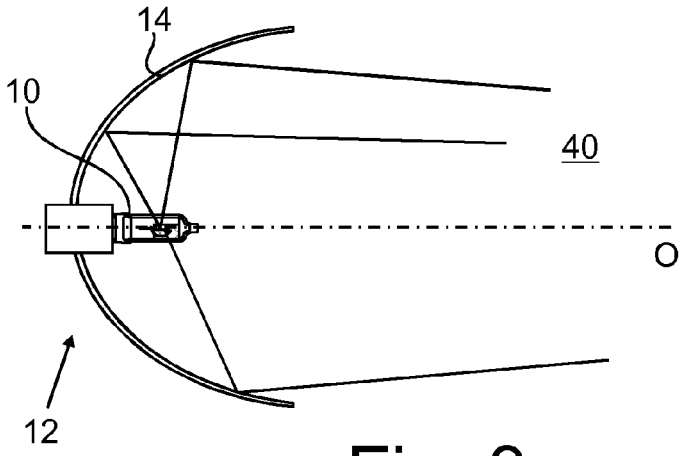
FIG. 3 shows a schematic side view of the lamp of FIG. 1, FIG. 2 arranged in a reflector.

An illumination beam portion 40 of the light emitted from the low-beam filament 20 is used, as schematically shown in FIG. 3, to achieve a main beam of illumination 40 on the road in front of the motor vehicle. The portion which is here regarded as the illumination beam of light 40, i. e. the main portion of the luminous flux, is emitted into radial angular regions of a width of 120° as shown in FIG. 2, centered in directions opposite to the position of the shield 22. In the side view of FIG. 1, the angular region of the illumination beam of light 40 covers a range of +/−30° from the central plane A. In the context of the present embodiment, the portion of light emitted from the low-beam filament 20 into the thus defined angular regions is referred to as the illumination beam of light 40, whereas portions of light emitted into angular regions outside of this range are referred to as peripheral portions of light.

The above described lamp is of a lamp type known as H4. In the reflector 14 shown in FIG. 3, the light of the illumination beam 40 emitted from the lamp 10 is reflected to the front of the motor vehicle to form a low-beam light intensity distribution, i. e. an intensity distribution with a roughly horizontal bright/dark cutoff. This low-beam distribution with a horizontal bright/dark cutoff is obtained in the reflector 14, because the main illumination beam 40 emitted from the low-beam filament 20 has, due to the partial shielding by the shield 22, already a bright/dark cutoff in the intensity distribution. In contrast, if the high-beam filament 18 is operated, which has no associated shield, the resulting light intensity distribution formed by the reflector 14 has no bright/dark cutoff.

The light emitted from the filament 20 is of white color. In the present context, a white color will be referred to for light fulfilling the ECE requirements in this respect, i. e. for light with color coordinates within the white field.

As the light emitted from the filament 20 passes through the glass wall of the lamp vessel 16, it remains white, i. e. does not undergo a color change. According to the present embodiment, the lamp 10 comprises a color filter portion provided as a color filter coating 30 on the outside of the lamp vessel 16.

There are different possible embodiments of a color filter coating 30 which serves to absorb certain wavelengths of incident light, such that a white beam of light passing through the color filter coating 30 undergoes a color change. Also, different color effects may be achieved, such that the filtered light assumes e.g. green, yellow, pink/purple, orange, or blue color.

In preferred examples, coatings with different absorption properties may be provided for different colors, e.g. with about 40% absorption for green, about 10% absorption for yellow, about 60% absorption for orange and about 50% absorption for blue, and about 60% absorption for a pink/purple color filter coating 30.

Further, the opaque top coating 38 is provided with the same color as achieved by the color filter coating 30.

Of the light emitted from the low-beam filament 20, the illumination beam of light 40, as defined by the above angular regions, passes through a portion of the lamp vessel 16 with no color filter, which in the present context will be referred to as a color transparent portion 32 of the lamp vessel 16.

As visible from FIG. 1, FIG. 2, the color filter coating 30 of the first embodiment is applied to the lamp vessel 16 as a partial ring around the circumference of the lamp vessel 16, thus forming a partial cylinder surface. In longitudinal extension, along the longitudinal axis L, the color filter coating 30 overlaps the longitudinal extension of the low-beam filament 20; the lower ends thereof coincide, whereas the longitudinal extension of the color filter coating 30 is about twice the longitudinal extension of the low beam filament 20.

In the measurement plane A, the color filter coating 30 is provided over the entire angular range of the shielded region 24. However, as shown, the color filter coating 30 extends beyond the shielded region 24 on both sides and overlaps with the non-shielded region by about 30° on one side of the shield 22, and by about 5° on the other side. The color filter coating 30 is thus arranged non-symmetrically to the shield 22, with a wider first peripheral portion 26*a* on one side and a more narrow second peripheral portion 26*b* on the other.

Figure 4:
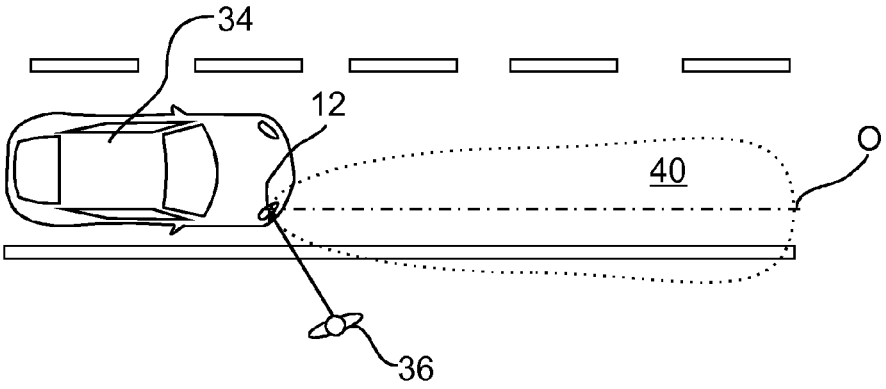
FIG. 4 shows in a top view a partly schematic representation of a motor vehicle with a headlight of FIG. 3.

The optical effect achieved by the partial color filter coating 30 is as follows: Since the color filter coating 30 is arranged such that the above defined illumination beam of light 40 passes only through the color transparent portions 32 of the lamp vessel 16, light emitted from the lamp 10 into the directions of the illumination beam of light 40 is not affected by the color filter coating 30. Thus, the illumination beam of light 40, as reflected by the reflector 14 of the headlight 12, achieves a non-colored illumination on the road in front of a vehicle 34 (FIG. 4).

However, light emitted from the filament into the peripheral regions 26*a*, 26*b* (in the central plane A, shown in FIG. 2) pass through the color filter coating 30 and undergo a color change. Thus, these portions of light emitted from the lamp 10 will be correspondingly colored light. However, since this applies only to peripheral portions 26*a*,26*b* which in the reflector 14 are reflected under larger angles with the optical axis O, these will not substantially contribute to the color of the illumination in front of the motor vehicle, but will be reflected into peripheral directions, arranged at greater angles with the optical axis O.

A further portion of light which will appear colored is scattered light passing through the color filter coating 30 in the shielded region 24. While the shielded region 24 is shielded from direct light from the low-beam filament 20, there will be a certain amount of light emitted from the low-beam filament 20 which is scattered, e. g. partially reflected at the wall of the lamp vessel 16, or at the holding wires therein, etc. This scattered portion of light will have a comparatively small amount of luminous flux as composed to the illumination beam 40. However, the scattered portion of light will be emitted as colored light into directions outside of the illumination beam 40, i. e. into directions where it will be noticeable if the headlight 12 is observed not directly from the front, but under larger angles with the optical axis O.

A still further portion of light which will appear colored is scattered light reflected at the surface of the opaque, colored top cover 38. This scattered light will also be emitted into different directions, also outside of the illumination beam 40.

In consequence, the optical effect obtained by the described lamp is such that the illumination beam of light 40 emitted from the lamp and reflected within the headlight 12 by the reflector 14 to illuminate the road in front of the motor vehicle 34 will be white (in the sense of the ECE regulations). However, if the headlight 12 is observed from the side, the scattered portion of light passing through the color filter coating 30 in the shielded region 24, the peripheral portions 26 of light passing from the low-beam filament directly through the color filter portion 30, and any scattered light portions reflected at the colored top 38 will achieve a strongly colored appearance in the headlight.

FIG. 4 shows in a top view how the illumination beam pattern 40 of the headlight 12 is reflected onto the road in front of a motor vehicle 34 under relatively small angles with the optical axis O. Under these directions, a illumination beam 40 from the lamp 10 is effective, such that this illumination beam pattern is white.

However, to an observer 36 looking from the side, i. e. under greater angles with the optical axis O, the scattered and reflected light portions and peripheral light portions 26 are strongly visible, such that the headlight 12 appears colored.

The lamp 10 can thus be used as a standard automotive halogen lamp, e. g. a H4 lamp, which fully conforms to all regulation and standard requirements, while at the same time a surprising coloration effect may be observed in the headlight 12.

Figure 5:
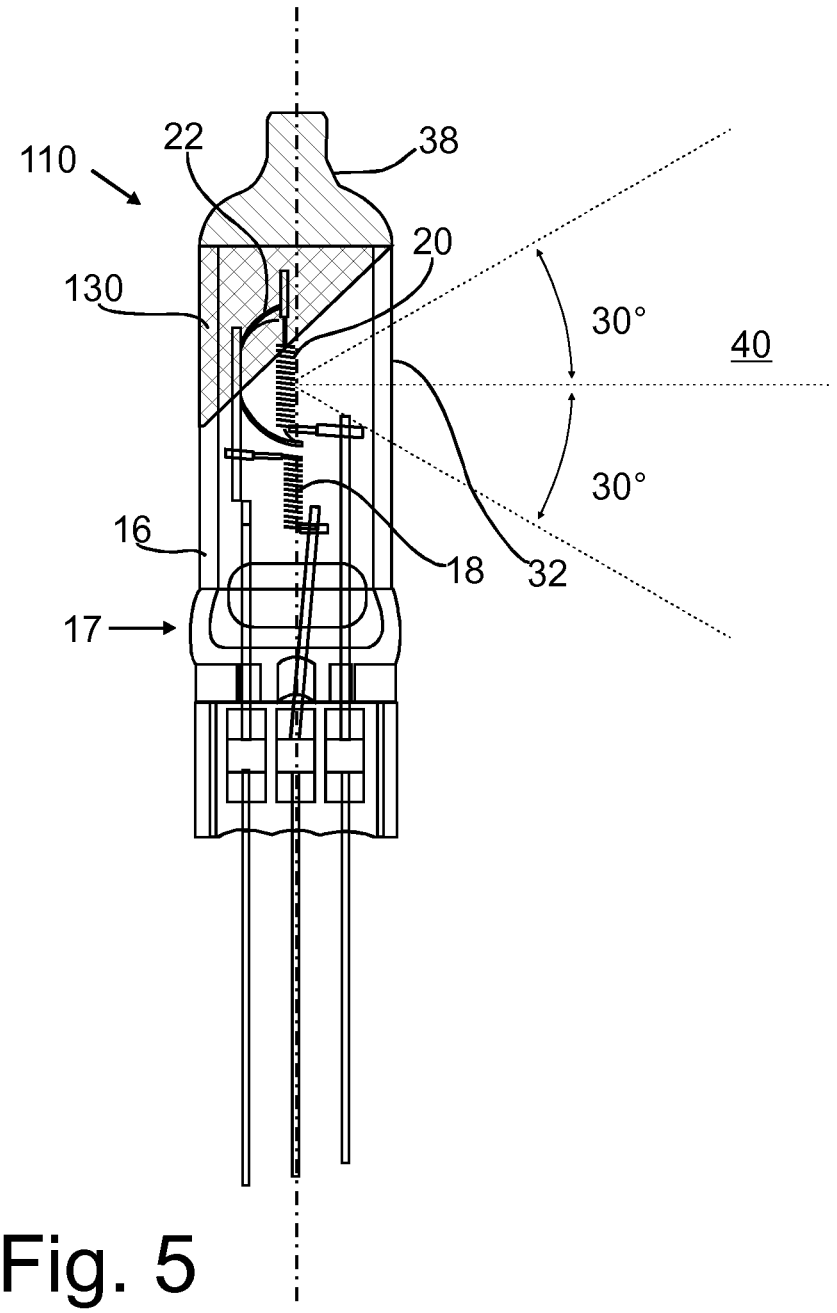
FIG. 5 shows a side view of a second embodiment of a lamp.

FIG. 5 shows an example of a further embodiment of a lamp 110 with a differently shaped color filter coating 130. Since the second embodiment largely corresponds to the first embodiment, like parts are designated by like reference numerals.

In the example of FIG. 5, the color filter coating 130 is not provided as a partial cylinder shape, but has, in the side view shown, a lower edge that is oriented under an angle to the measurement plane. As visible, the color filter coating 130 is arranged such that the main illumination beam 40 only passes through the color transparent portion 32 and remains uncolored.

Figure 6:
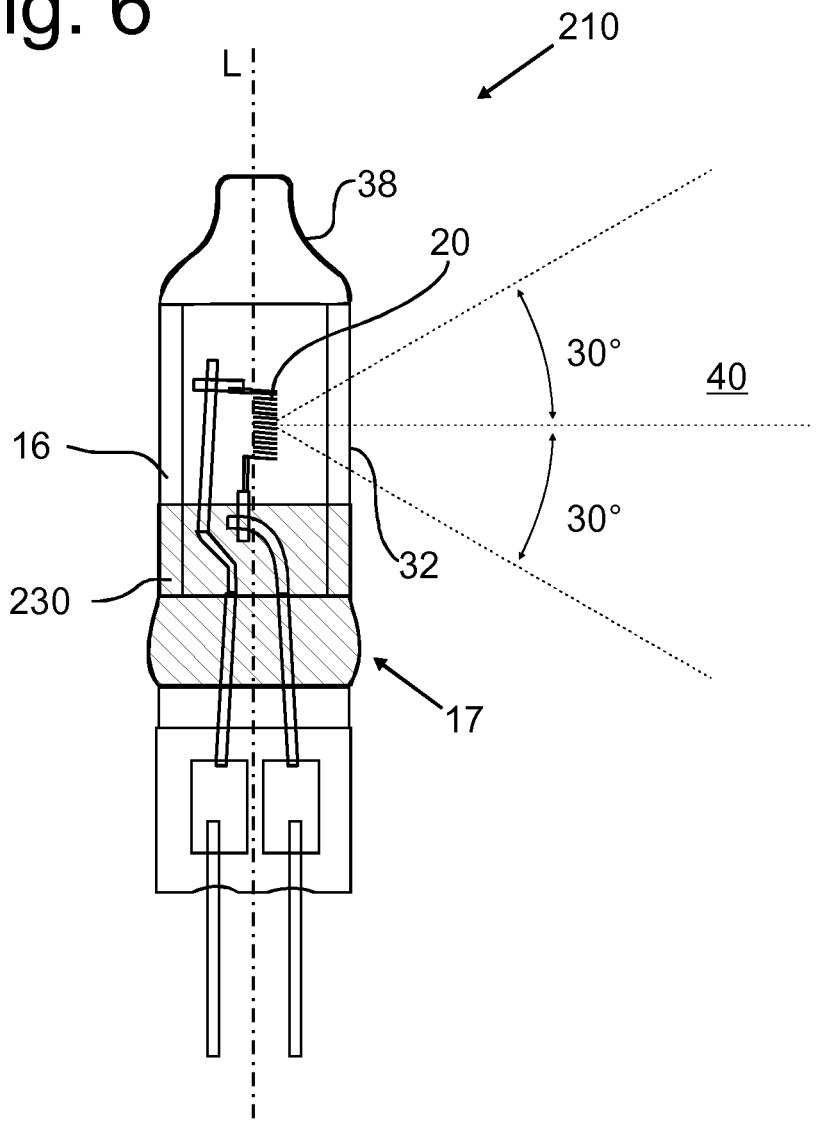
FIG. 6 shows a side view of a third embodiment of a lamp.

FIG. 6 shows a still further embodiment of a lamp 210. Again, parts corresponding to the first and second embodiments are designated by like reference numerals.

The lamp 210 of the third embodiment is a single filament lamp, where consequently no shield is provided adjacent to the filament 20. For this type of lamp, which may e.g. be a H7 lamp, a color filter coating 230 as shown may be provided in a lower portion of the lamp vessel 16. The color filter coating 230 has a cylinder shape surrounding the lamp vessel 16. In the example shown, the color filter coating 32 extends between a pinch seal portion 17 and an upper edge. The upper edge of the color filter portion 230 is arranged below the filament 20. The color transparent portion 32 of the lamp vessel 16 is arranged directly adjacent, above the color filter portion 230 and surrounds the filament 20, such that, as visible from FIG. 6, the main illumination beam 40 only passes through the color transparent portion 32. Provided above and directly adjacent to the color transparent portion 32 is an opaque top covering 38, which is colored in the same color as the color filter portion 230.

In the case of the lamp 210 which does not have a shield, both the color transparent portion 32 and the color filter portion 230 are cylinder-shaped and cover all 360° of radial directions. The lamp 210 achieves, as described above for the first and second embodiments, a white main illumination beam 40. However, due to reflection at the color top cover 38 and due to peripheral light portions as well as scattered light colored by the color filter portion 230, the light emitted from the lamp 210 and from a headlightl 1 equipped with the lamp 210 is perceived as having a color appearance.

The invention has been illustrated and described in detail in the drawings and foregoing description. Such illustration and description are to be considered illustrative or exemplary and not restrictive; the invention is not limited to the disclosed embodiments.

A skilled person will recognize that a number of modifications may be made to the above described lamp. For example, the size and position of the color filter coating 30 may vary as long as a main illumination beam 40 remains uncolored.

In the claims the word "comprising" does not exclude other elements, and the indefinite article "a" or "an" does not exclude a plurality. The mere fact that certain measures are recited in mutually different dependent claims or are described above in mutually different embodiments does not indicate that a combination of these measures cannot be used to advantage. Any reference signs in the claims should not be construed as limiting the scope.

The invention claimed is:

1. Lamp suitable for use in an automotive headlight, comprising:

at least one filament arranged within a transparent lamp vessel, and the lamp vessel being bounded at one end of a longitudinal axis of the lamp by a top end and at another end of the longitudinal axis of the lamp by a lower end portion, said lamp vessel comprising:

a color filter portion through which light is emitted with a color change, said color filter portion being arranged such that a peripheral or a scattered portion of light from said filament is emitted through said color filter portion to achieve a color appearance, a color transparent portion through which light is emitted without a color change, said color transparent portion being arranged such that an illumination beam of light is emitted from said filament through said color transparent portion to achieve a non-colored illumination, said color transparent portion, at least for part of the circumference of the lamp vessel, extending between the top end and the lower end portion, and an opaque top cover covering the top end, a surface of said top cover having a color corresponding to the color of the light emitted through said color filter portion.

2. Lamp according to claim 1, wherein:

at least one shield is arranged adjacent to said filament to partly block light emitted from said filament into radial directions within an angular shielded region, and at least a part said color filter portion is arranged within said angular shielded region.

3. Lamp according to claim 2, wherein said color filter portion covers, in a central plane that is perpendicular to the longitudinal axis of the lamp, an angular region that is at least as wide as the angular shielded region.

4. Lamp according to claim 3, wherein said color filter portion has an angular width which is 120-160% of the width of the angular shielded region.

5. Lamp according to claim 2, wherein said color filter portion has a longitudinal extension along the longitudinal axis of said lamp which is 50-200% of the longitudinal extension of said shield.

6. Lamp according to claim 3, wherein said color filter portion is arranged non-symmetrically relative to said shield.

7. Lamp suitable for use in an automotive headlight, comprising:

at least one filament arranged within a transparent lamp vessel, and the lamp vessel being bounded at one end of a longitudinal axis of the lamp by a top end and at another end of the longitudinal axis of the lamp by a lower end portion, said lamp vessel comprising:

a color filter portion through which light is emitted with a color change, said color filter portion being arranged such that a peripheral or a scattered portion of light from said filament is emitted through said color filter portion to achieve a color appearance, a color transparent portion through which light is emitted without a color change, said color transparent portion being arranged such that an illumination beam of light is emitted from said filament through said color transparent portion to achieve a non-colored illumination, wherein:

said color transparent portion, at least for part of the circumference of the lamp vessel, extends between the top end and the lower end portion, and said illumination beam of light is emitted in vertical directions forming angles of at least +/−30° with a central plane in which a center of the filament is arranged, the central plane being oriented perpendicular to the longitudinal axis of the lamp.

8. Lamp according to claim 1, wherein said illumination beam of light is emitted in radial directions in a plane oriented perpendicular to the longitudinal axis of said lamp over an angular range of at least 120°.

9. Lamp according to claim 1, wherein a second filament is arranged within said lamp vessel for emitting a high-beam illumination beam of light into all radial directions through said color transparent portion.

10. Lamp according to claim 1, wherein said color filter portion comprises a color filter coating provided on said lamp vessel.

11. Headlighting arrangement for a motor vehicle, comprising:

a lamp according to claim 1, a reflector, where said reflector reflects said illumination beam of said lamp to form a non-colored illumination beam pattern projected along an optical axis, and where said scattered or peripheral portion of light is reflected in said reflector into peripheral directions to achieve a color appearance.

12. Lamp according to claim 7, wherein at least one shield is arranged adjacent to said filament to partly Hock light emitted from said filament into radial directions within an angular shielded region, and at least a part of said color filter portion is arranged within said angular shielded region.

13. Lamp according to claim 12, wherein:

said color filter portion covers, in a central plane that is perpendicular to the longitudinal axis of the lamp, an angular region that is at least as wide as the angular shielded region.

14. Lamp according to claim 13, wherein said color filter portion has an angular width which is 120-160% of the width of the angular shielded region.

15. Lamp according to claim 12, wherein said color filter portion has a longitudinal extension along a longitudinal axis of said lamp which is 50-200% of the longitudinal extension of said shield.

16. Lamp according to claim 12, wherein said color filter portion is arranged non-symmetrically relative to said shield.

17. Lamp according to claim 7, wherein the lamp vessel further comprises an opaque top cover covering the top end, a surface of said top cover having color corresponding to the color of the light emitted through said color filter portion.

18. Lamp according to claim 7, wherein aid illumination beam of light is emitted in radial directions in a plane oriented perpendicular to the longitudinal axis of said lamp over an angular range of at least 120°.

19. Lamp according to claim 7, wherein a second filament is arranged within said lamp vessel for emitting a high-beam illumination beam of light into all radial directions through said color transparent portion.

20. Lamp according to claim 7, wherein said color filter portion comprises a color filter coating provided on said lamp vessel.

21. Headlighting arrangement for a motor vehicle, comprising:

a lamp according to claim 7, a reflector reflecting said illumination beam of said lamp to form a non-colored illumination beam pattern projected along an optical axis, and wherein said scattered or peripheral portion of light is reflected in said reflector into peripheral directions to achieve a color appearance.

* * * * *